United States Patent [19]

Smith

[11] Patent Number: 4,475,676

[45] Date of Patent: Oct. 9, 1984

[54] EASY CARRY-EASY ACCESS GOLF MARKER AND TEE CADDY

[76] Inventor: Cecil D. Smith, 69 Carla Way, Broomfield, Colo. 80020

[21] Appl. No.: 489,018

[22] Filed: Apr. 27, 1983

[51] Int. Cl.[3] ..... A45F 5/00; A63B 57/00

[52] U.S. Cl. ..... 224/247; 24/3 E; 24/3 J; 206/315.1; 224/252; 224/918; 224/269; 273/32 A; 273/32 B

[58] Field of Search ..... 224/268, 269, 918, 252, 224/247; 206/315.1; 273/32 A, 32 D, 32 R, 32 B; 24/3 E, 3 L, 3 C, 3 D, 3 J, 11 HC, 10 R, 11 PP; D21/208

[56] References Cited

U.S. PATENT DOCUMENTS

| | | | |
|---|---|---|---|
| 803,464 | 10/1905 | Beck | 24/11 PP |
| 1,484,321 | 2/1924 | Brouillette et al. | 24/3 J X |
| 1,627,145 | 5/1927 | Breed | 206/315.1 |
| 2,425,561 | 8/1947 | Quidas | 24/10 R |
| 3,753,519 | 8/1973 | Gammon | 224/918 X |

*Primary Examiner*—Allan N. Shoap

[57] ABSTRACT

This device is a clip having a mouth on opposite sides, one for clipping to a supporting object, and the other for a plurality of golf ball markers being clipped therein, and one of the clip sides including bent-up tongues, behind which golf ball tees are clipped.

1 Claim, 4 Drawing Figures

EASY CARRY-EASY ACCESS GOLF MARKER AND TEE CADDY

This invention relates generally to golf game accessories. More specifically, it relates to holders that retain golf game accessories, such as golf ball markers and tees.

It is well known to those persons who are golf game enthusiasts, that accessories such as golf ball markers and tees are preferably kept handy during the progress of a game, so as to be readily available whenever needed. Accordingly, they are often carried in a player's pocket, but this is not ideal if other things, like keys and a handkerchief, are also carried therein, so that the needed game accessory cannot be too readily located. This is objectionable, so that this situation is therefore in need of an improvement.

Accordingly, it is a principal object of the present invention to provide a holder for retaining a plurality of golf ball markers and tees, and which may be readily clipped anywhere on a golfer's clothing, or else on other golfing paraphernalia, such as the golf bag, so as always to be accessible conveniently, when wanted.

Another object is to provide an easy carry-easy access golf marker and tee caddy, which, when intended to be worn, is suitable for both men and women players' garments.

Other objects are to provide an easy carry-easy access golf marker and tee caddy, which is simple in design, inexpensive to manufacture, rugged in construction, easy to use, and efficient in operation.

These, and other objects, will be readily evident, upon a study of the following specification, and the accompanying drawing, wherein.

Figure 1:
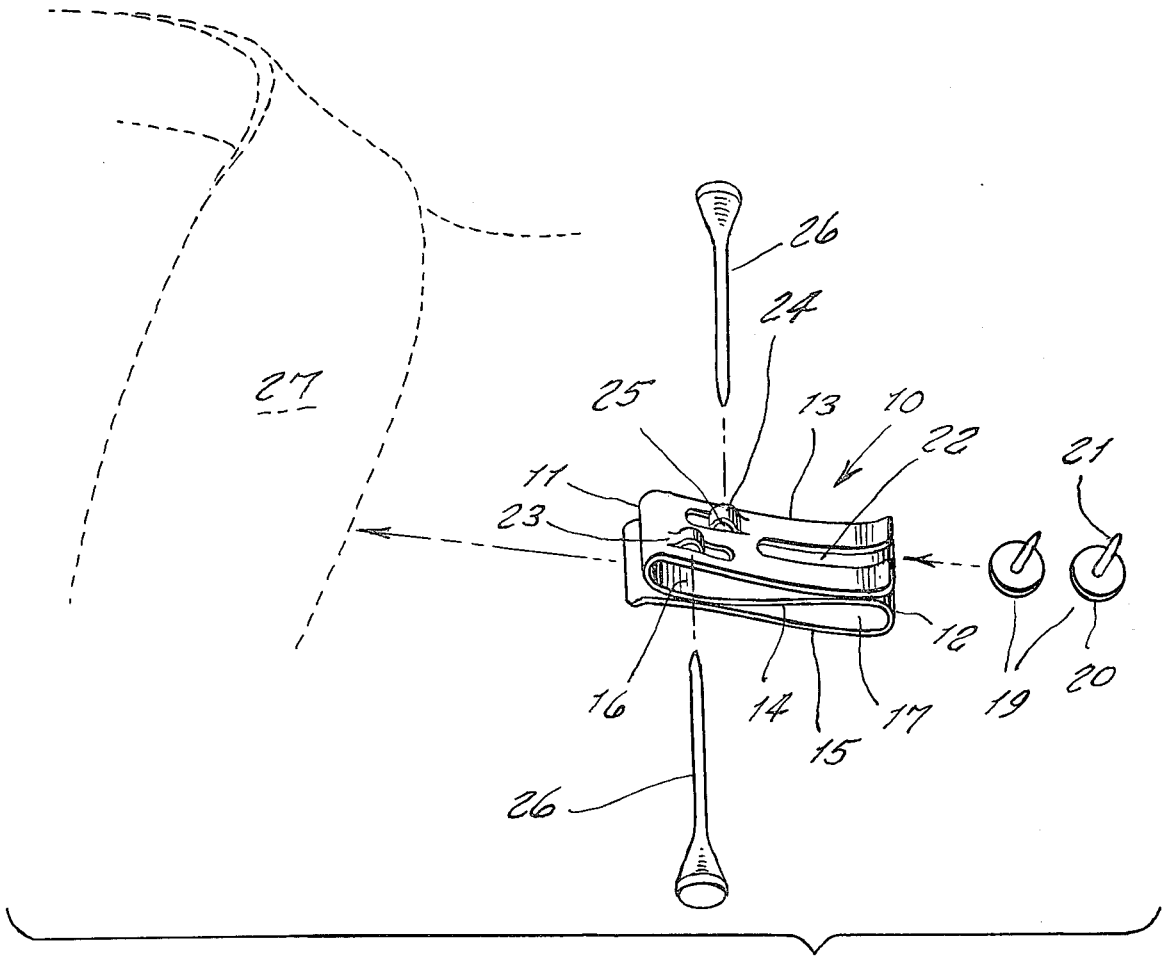
FIG. 1 is a front perspective view of the invention, shown positioned for attachment to a garment lapel, while tees and golf ball markers are positioned for placement on the device.
Figure 2:
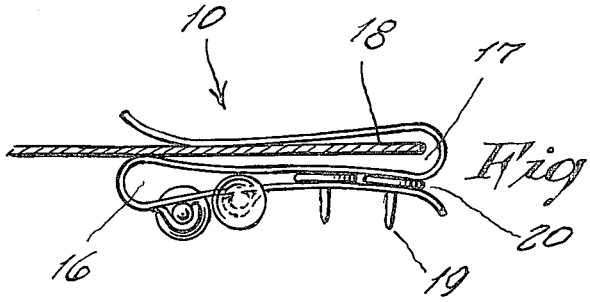
FIG. 2 is a top plan view thereof, shown assembled.
Figure 3:
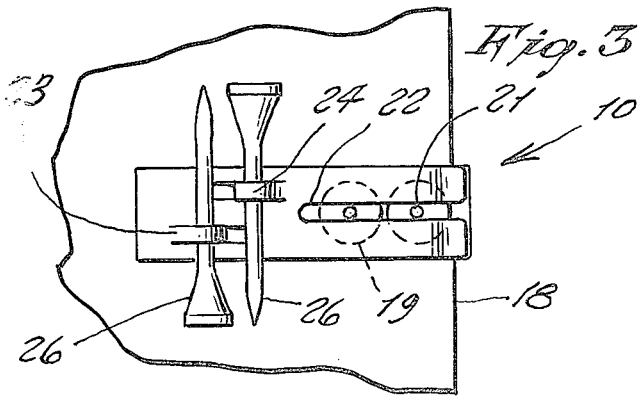
FIG. 3 is a front elevation view thereof.
Figure 4:
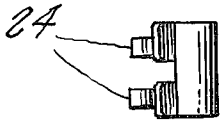
FIG. 4 is a right end elevation view of the device, shown alone.

Referring now to the drawing in greater detail, the reference numeral 10 represents an easy carry-easy access golf marker and tee caddy, according to the present invention, wherein the caddy simply comprises a generally "S"-shaped clip, formed from a single strip of spring steel, or molded from an elastomeric thermoplastic, or thermosetting material and wherein the clip is squashed relatively flat, so that there are two generally "U"-shaped bends 11 and 12 formed between three generally flat jaws 13, 14 and 15. A mouth 16 is formed between one end jaw 13 and the center jaw 14 while another mouth 17 is formed between the other end jaw 15 and the center jaw 14. The opening to each mouth is widened by means of each terminal end of the jaws 13 and 15 being outwardly rounded, so as to allow easy entry of a garment edge 18 into one mouth 17 and easy insertion of golf ball markers 19 into the other mouth 16.

Each of the golf ball markers includes a wide circular head 20, at one end of a short pin 21. Accordingly, in order to insert the marker heads into the mouth 16, the jaw 13 includes a slot 22, extending from an end thereof, in order to receive the pin of each marker. Thus, the markers are held within the mouth by means of the marker heads being clamped between the jaws 13 and 14.

The jaw 13 also includes two tongues 23 struck out therein, each tongue having a semi-circular, rolled-up bend 24 at its terminal end, the rounded portion of the bend bulging outwardly beyond the outer side of the jaw 13, in order to expose end openings of a hole 25 formed in the bend 24, and through which a golf ball tee 26 is inserted. Thus, the tee is frictionally held between the rolled-up bend and a front side of the jaw 13.

In use, the caddy is clipped either to golf paraphernalia, such as a golf bag, or else to a player's cap or garment, such as the jacket lapel 27, shown in FIG. 1. When a marker is needed, it is simply slid out of the end of the mouth 16. When a tee is needed, it is simply slid out of one end of the hole 25.

While various changes may be made in the detail construction, it is understood that such changes will be within the spirit and scope of the present invention, as is defined by the appended claims.

What I claim as new is:

1. A caddy for carrying a plurality of golf ball markers and a plurality of golf ball tees, comprising a flattened, generally "S"-shaped clip formed from a single strip of resilient material, and including three generally flat jaws connected together by two "U"-shaped bends between their connecting ends, said jaws comprising a center jaw located between a pair of end jaws; a mouth formed at each opposite end of said clip, each said mouth being formed between a terminal end of one said end jaw and one said "U"-shaped bend, each said mouth being widened by said terminal end being outwardly rounded, one said mouth serving to receive a supporting object for said clip, while the other said mouth receives said golf ball markers; a slot on one said end jaws extending from said terminal edge thereof, and communicating with said mouth for said slot receiving a pin of each said marker when said mouth receives a wide head thereof for being clamped between the last said end jaw and said center jaw; and a plurality of tongues struck out within a central portion of the last said end jaw, each said tongue having a semicircular, rolled-up bend at its terminal end, which bulges outwardly beyond an outer side of said end jaw for receiving and frictionally holding a golf tee between said rolled-up bend and said jaw outer side.

* * * * *